US005097777A

United States Patent [19]

Porter et al.

[11] Patent Number: 5,097,777

[45] Date of Patent: Mar. 24, 1992

[54] METHOD AND APPARATUS FOR PRELOADING MATERIAL TO BE SEWN INTO A SEWING MACHINE AND FOR COMPENSATING FOR UNEVEN LENGTHS OF SUCH MATERIALS

[75] Inventors: Michael R. Porter, Topsfield; John J. Kirby, South Hamilton, both of Mass.

[73] Assignee: Porter Sewing Machines, Inc., Beverly, Mass.

[21] Appl. No.: 482,303

[22] Filed: Feb. 20, 1990

[51] Int. Cl.[5] ..... D05B 33/00

[52] U.S. Cl. ..... 112/306; 112/262.3; 112/314

[58] Field of Search ..... 112/306, 121.11, 121.12, 112/121.29, 2, DIG. 2, 262.1, 262.3, 265.1, 104, 113, 114, 153, 314

[56] References Cited

U.S. PATENT DOCUMENTS 3,867,889 2/1975 Conner, Jr. ..... 112/121.11

3,980,032 9/1976 Kleinschmidt et al. ... 112/121.11 X 4,086,860 5/1978 Kosrow et al. ..... 112/306 X 4,498,404 2/1985 Sadeh ..... 112/DIG. 2 X 4,756,261 7/1988 Gershoni ..... 112/DIG. 2 X

*Primary Examiner*—Peter Nerbun

*Attorney, Agent, or Firm*—Wolf, Greenfield & Sacks

[57] ABSTRACT

An improved method and apparatus is provided for use in a sewing machine. The improvements include preloading two pieces of material which are to be sewn together. The preloading is accomplished by positioning pieces of material to be sewn under a gripper spaced from the sewing head on a table while prior pieces of material are being sewn. The gripper engages the material and, when the prior sewing operation is completed, the gripper is moved across the table toward the sewing head to load the preloaded pieces of material. When the two pieces of material are preloaded, most of the material hangs over an edge of the table and the lengths of the pieces of material are determined by movable detectors.

20 Claims, 7 Drawing Sheets

METHOD AND APPARATUS FOR PRELOADING MATERIAL TO BE SEWN INTO A SEWING MACHINE AND FOR COMPENSATING FOR UNEVEN LENGTHS OF SUCH MATERIALS

FIELD OF THE INVENTION

This invention relates to sewing machines and more particularly to method and apparatus to preload two pieces of material to be sewn into the sewing machine while sewing operation is being performed to enhance machine production and to compensate for uneven lengths of the two pieces of material.

BACKGROUND OF THE INVENTION

There are a number of commercial sewing machines on the market, one such sewing machine being described in U.S. Pat. No. 4,825,781 issued May 2, 1989. Machines of this type do a very good job of sewing together two pieces of material, such as the seam of a pants leg; however, such machines do have certain limitations.

The first such limitation is that the machine operator cannot load new material to be sewn into the machine until sewing on the prior material is completed. The loading operation is also completely manual. Thus, for one exemplary machine, while it takes approximately six seconds for the machine to sew a pants leg, it can take up to twelve additional seconds for a new piece of material to be loaded into the machine. It thus takes approximately eighteen seconds to sew a pants leg in this machine, with only approximately one third of that time being used for actual sewing. Therefore, in order to increase production from a given machine, it is desirable to be able to reduce the time required for loading the machine, and in particular to permit preloading of material into the machine so that there is some overlap between loading time and sewing time. By simplifying the load procedure permitting preload so that the loading operation may occur at the same time the sewing operation is being performed, and permitting the actual loading operation to be performed automatically, it should be possible to reduce the time required to sew for example a pants leg by as much as 50%, and even greater time savings may be possible.

The second problem is that, no matter how carefully the material is originally cut, there are frequently differences in the length of the two pieces of material being sewn. It is known that such differences in length can be compensated for by changing the feed rate at the sewing head for either one or both of the pieces of material so that on of the pieces of material has a little extra fullness in some area and/or the other piece of material is stretched slightly. For a pants leg, it is preferable that this adjustment be made over the top third of the leg (i.e. in the area above the knee). However, heretofore, the operator has been relied upon to estimate the amount of mismatch between the two pieces of material being sewn together and to manually adjust the feed rate to compensate for such mismatch. This extra labor on the part of the operator accounts in part for the time required to load ne pieces of material to be sewn into the machine. The need for the operator to estimate and make manual adjustment for mismatches also means that the operator must have a certain skill level, the need for more highly skilled operators also increasing costs. Thus, production time could be reduced, thus further reducing cost, if a mechanism were provided for automatically detecting mismatches in the pieces of material to be sewn and compensating for such mismatches.

A need therefore exists for an improved method and apparatus which increases the production obtainable from a sewing machine, and thus reduces the cost of operation thereof, by permitting preloading of material to be sewn during a prior sewing operation, and by permitting automatic detection of material mismatches and compensation for such mismatches.

SUMMARY OF THE INVENTION

In accordance with the above, this invention provides a method and apparatus for preloading two pieces of material which are to be sewn together into a sewing machine. The sewing machine has a table with the sewing head being mounted near one end thereof and an arm mounted above the table which arm is normally positioned at a distance from the sewing head. At least two grippers extend from the arm toward the table with the operator positioning the piece of material between the gripper and the table to preload the material. When the material is properly preloaded, the grippers engage the material. When the sewing head is ready to receive the material, having completed the prior sewing operation, the arm, and thus the preloaded material engaged by the grippers, is moved across the table toward the sewing head. When the material reaches the sewing head, it is disengaged from the grippers and the arm is then returned to its normal position. A separator is preferably positioned by the operator to keep the two pieces of material apart. When a separator plate at the sewing head is between the two pieces of material, the separator inserted by the operator may be kicked out or otherwise removed.

For the preferred embodiment, only a portion of the preloaded two pieces of material are on the table, with most of the material hanging down over an edge of the table. A table extension from that the edge is provided, at least in the area of the sewing head, which extension is normally down with its plane substantially at a right angle to the plane of the table. However, when the material is at the sewing head, the table extension is raised to be in substantially the same plane as the table.

A sensor is also provided for each piece of material, and a suitable means as provided for moving the sensors along the length, for example, of the hanging portion for the preferred embodiment, of the material when the material is in the preload position to detect length mismatches. The sewing means include a means responsive to a difference in length between the two pieces of material for altering the feed rate for at least one of the pieces of material for at least a portion of the sewing operation.

The foregoing and other objects, features and advantages of the invention will be apparent from the following more particular description of a preferred embodiment of the invention as illustrated in the accompanying drawings.

IN THE DRAWINGS

DETAILED DESCRIPTION

Figure 1:
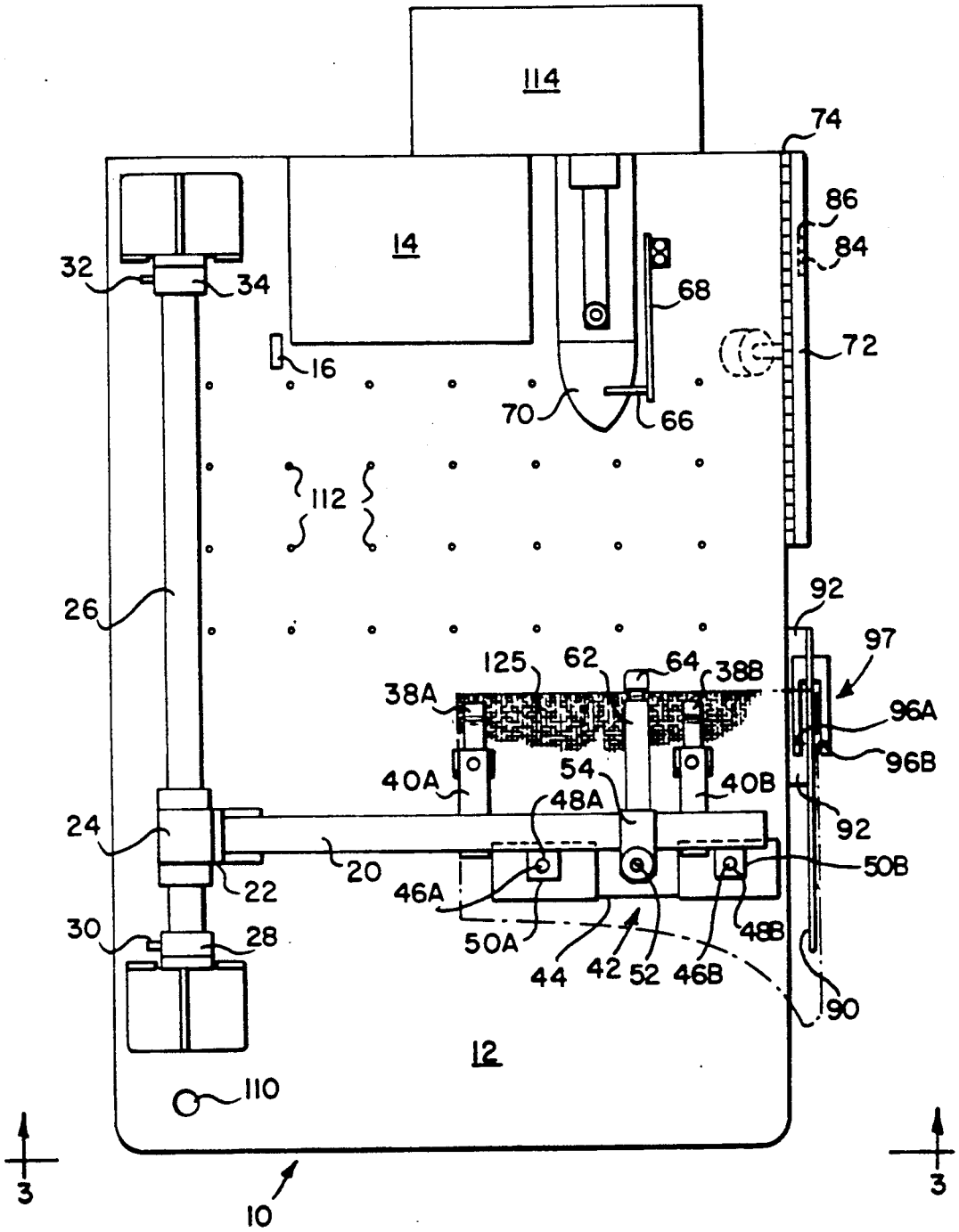
FIG. 1 is a top view in semiblock form of a sewing machine incorporating the teachings of this invention with the machine in the preload position.

FIGS. 1-5 show a sewing machine of a preferred embodiment which incorporates the teachings of this invention. Referring to these figures, the sewing machine 10 has a table 12, the top surface of which is preferably of a low friction material. A sewing head 14 is mounted at one end of table 12. The sewing head may for example be of the type shown and described in conjunction with the before mentioned Pat. No. 4,825,781. However, since the exact nature of the sewing head does not form part of the present invention, the sewing head is shown only in block form and the details of this head ar not described herein. For purposes of this invention it will be assumed that material moves from right to left, as viewed in FIG. 1, through the sewing head. A suitable detector 16, such as a photo detector, is provided adjacent the left side of sewing head 14 to detect when material being sewn has exited the head. For example, assuming the top surface of table 12, at least in the area thereof under detector 16, is reflective, there would be an output from the photodetector when no material is thereunder. However, when material is between detector 16 and table 12 during a sewing operation, there would be no output from the detector.

An arm 20 is mounted above table 12, the arm being parallel to the table and spaced therefrom. The arm is normally in the preload position shown in FIGS. 1-3. Arm 20 is supported by a bracket 22 which is attached to a collar 24 which rides on a pneumatic guide rail 26. Pneumatic pressure to drive collar 24 along rail 26 toward sewing head 14 is provided from a pneumatic line 30 through chamber 28. Similarly, pneumatic pressure to drive collar 24 away from sewing head 14 is provided from a pneumatic line 32 through pneumatic chamber 34.

A pair of guide fingers 38A and 38B rest on the top of table 12 at their lower ends. At their other ends, the fingers are attached by brackets 40 to arm 20. A pressure plate assembly 42 is also mounted to arm 20. Assembly 42 consist of a pressure plate 44 having a pair of guide rods 46A and 46B extending therefrom. Each guide rod 46 passes through a corresponding guide hole 48A and 48B formed in a corresponding bracket 50A, 50B, which brackets are mounted by screws, rivets or other suitable means not shown to arm 20. The pressure plate assembly is completed by a pneumatic cylinder 52 which is mounted to arm 20 by a bracket 54. Pneumatic cylinder 52 has a piston 56 which is attached to the center of pressure plate 44 and in conjunction with the pneumatic cylinder controls the raising and lowering of the pressure plate assembly. Pneumatic pressure is applied to piston 52 from a suitable source through pneumatic line 58.

The final element attached to arm 20 is a separator finger 60 which is hingedly connected to a bracket 62. Bracket 62 is attached to arm 20. Finger 60 has a projection 64 at its upper end which is adapted to co act with bar or arm 66 mounted at the sewing head end of table 12 to kick separator 60 in a manner to be described later out from between two plies of material which are to be sewn. Arm 66 is supported by a bracket 68 which is attached to table 12. A separator plate 70 is also provided in the area of arm 66 which is adapted to fit between two pieces of material which are being sewn.

A table extension 72 is mounted to the right edge of table 12 by a pair of hinges 74. Table extension 72 is raised to the position shown in FIG. 4, where it is in the plane of table 12 by a pneumatic cylinder 74. Cylinder 74 is attached at one end by a shaft 76 to the housing 77 supporting table 12 and has a pneumatic piston 78 extending from its other end which piston is attached by a bracket 80 to the underside of table extension 72. Pneumatic pressure is applied to piston 74 through a pneumatic line 82. A detector 84, for example an optical detector which is mounted to table 12 by a bracket 86, is provided to indicate when material is no longer on table extension 72, at which time piston 74 may lower table 72 to the position shown in FIGS. 1 and 2 in preparation for the next material loading operation.

Figure 2:
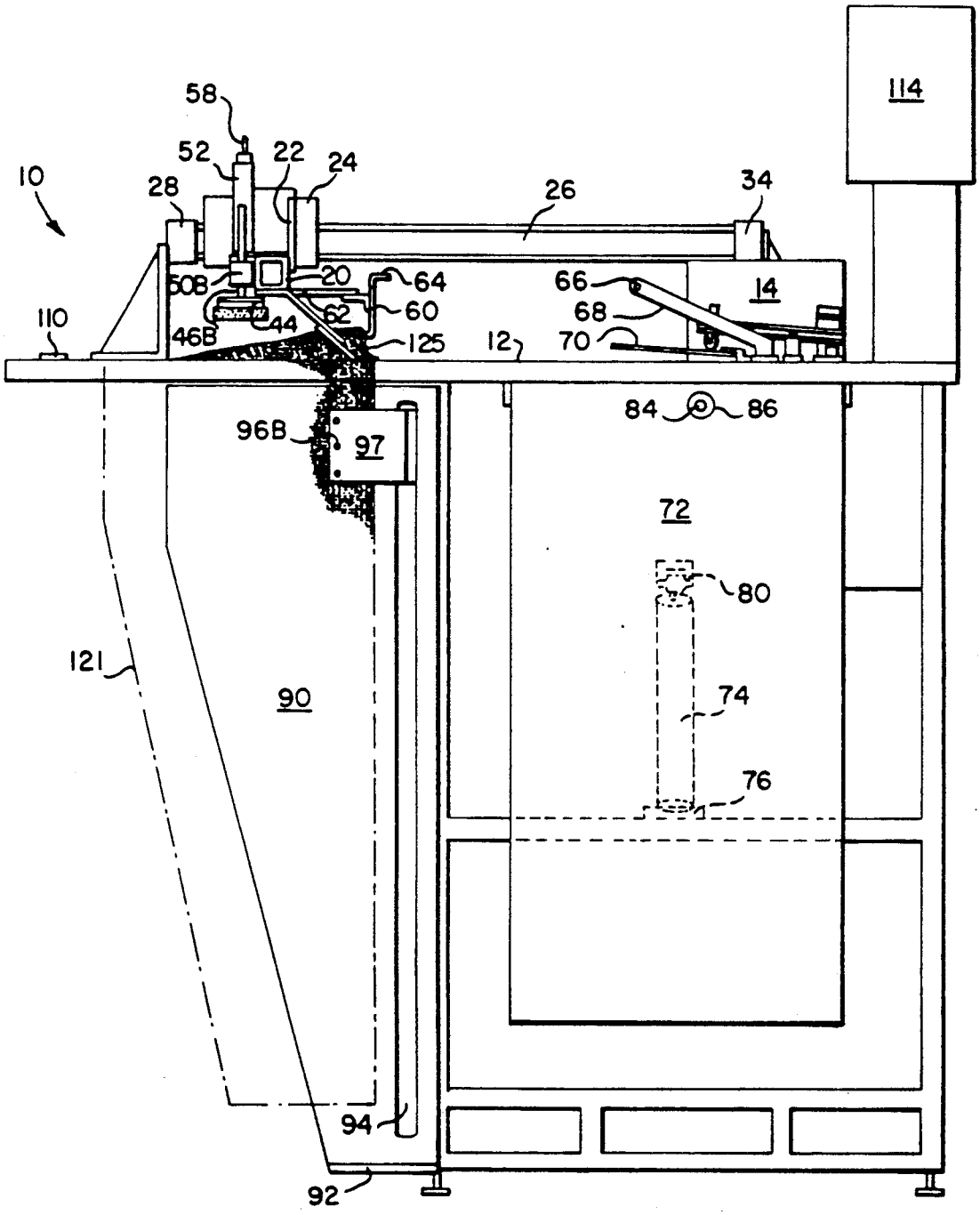
FIG. 2 is a side view taken generally along the line 2—2 in FIG. 1.
Figure 3:
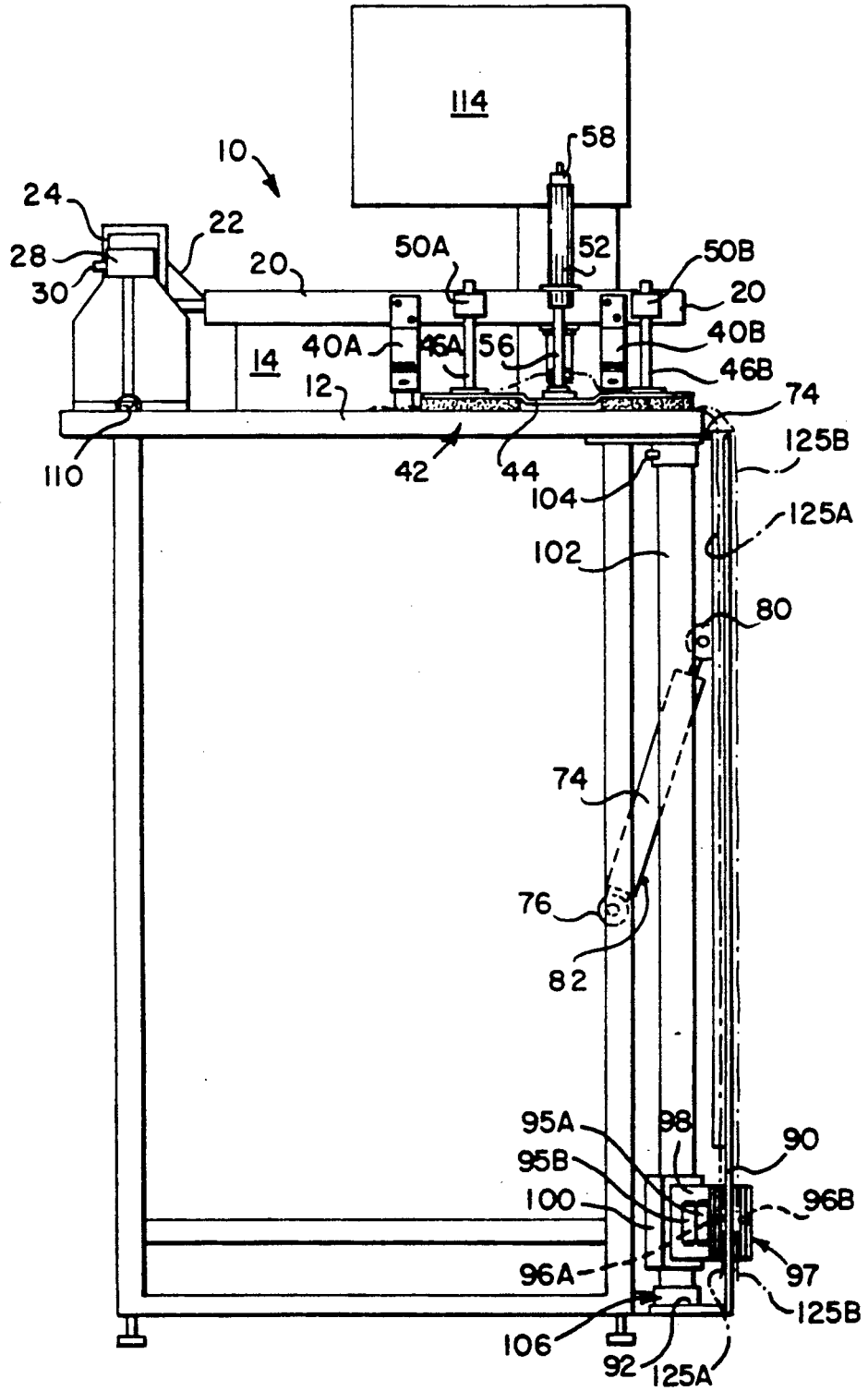
FIG. 3 is a back view taken generally along the line 3—3 in FIG. 1 with the apparatus at a slightly later stage in its operation than as shown in FIG. 2.
Figure 4:
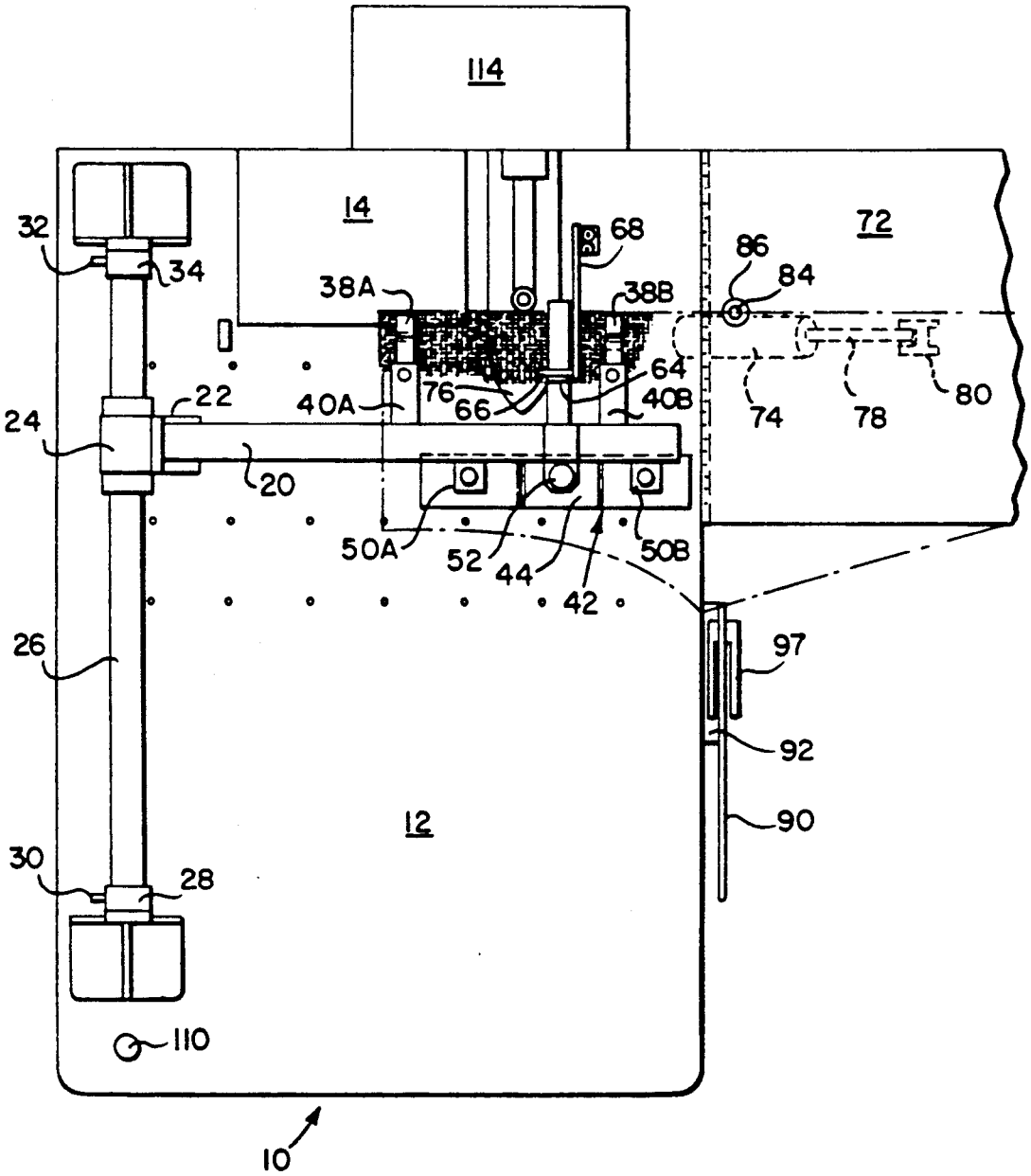
FIG. 4 is a top view of the apparatus shown in FIG. 1 with the apparatus in the load position.

A separator plate 90 is mounted to hang down from the right side of table 12 adjacent arm 20 when arm 20 is in its preload position shown in FIGS. 1 and 2. Plate 90 is supported by a bracket 92 attached by suitable means to table 12. Separator plate 90 has an open channel 94 formed therein. A pair of light sources 95A and 95B (FIG. 3) and corresponding photodetectors 96A and 96B are provided which are mounted to a detector assembly 97 attached by a bracket 98 to a collar 100 on pneumatic column 102. Pneumatic pressure to drive collar 100, and the detector assembly 97 attached thereto, downward is applied through pneumatic line 104 and pneumatic pressure to drive the collar and detectors in the upward direction to return them to the position shown in FIG. 2 is applied through pneumatic line 106. The function of the assembly consisting of elements 90-106 will be described shortly.

Table 12 also has a "ready" button 110 mounted thereon which the operator may hit when the preload operation has been completed. There are also a plurality of air holes 112 in the top surface of table 12 through which air under low pressure may be applied from a suitable source. Air may either be continuously applied through holes 112 or may only be applied when material is being moved from the preload to the sewing position. The function of air holes 112 and the air flowing therethrough is to provide air flotation for the material as it moves over table 12, thus further reducing friction between the material and the table.

A processor and control unit 114 is also provided which is operative to control the operation of the apparatus 10. In particular, control 114 controls appropriate valves (not shown) o other suitable pneumatic controls to apply pneumatic pressure to the various pneumatic lines at the appropriate points in the operation of the apparatus. While the sequence in which the valves are controlled to perform the various functions is important, and this sequence is illustrated in FIG. 7, the exact manner in which the various valves are controlled and in which the other controls are performed is not critical to the invention and these functions may be performed in any standard manner known in the art.

Figure 6:
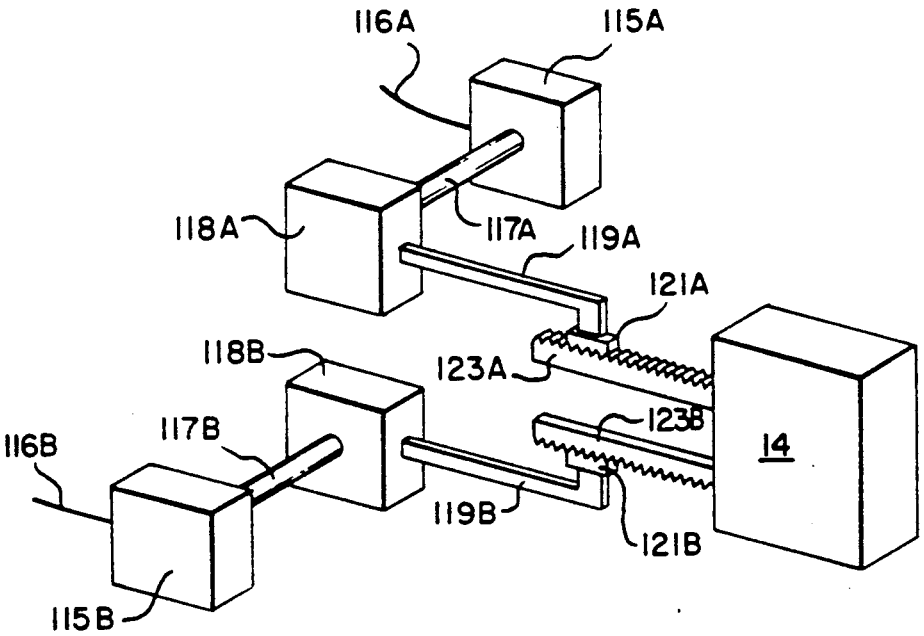
FIG. 6 is a partially schematic top front perspective view of an automatic feed rate control suitable for use with this invention.

Finally, referring to FIG. 6, the system has a pair of servomotors 115A and 115B which are controlled by suitable electrical lines, 116A and 116B respectively, from processor and control device 114 in response to a detection of a difference in length between two pieces of material to be sew or in response to a manually applied input. Each servomotor 115 has an output shaft 117A, 117B which is connected through a suitable gearing and linkage mechanism 118A, 118B to a shaft 119A, 119B having a pinion 121A, 121B at the end thereof. Each gear and linkage mechanism 118 converts a rotation of the corresponding shaft 117 into a suitable corresponding linear movement of pinion gears 121. Pinion gears 121 mesh with corresponding racks 123A and 123B extending from sewing head 14. Rack 123A is connected to an existing mechanism within the sewing head 14 which controls the feed rate for the upper ply of material being fed through the sewing head 14, while rack 123B connects to an existing mechanism in the sewing head which controls the rate at which the lower ply of material is fed through the sewing head. Thus, processor 114 may, by applying suitable inputs to servomotors 115A and 115B, independently control the feed rate of each ply of material. The manner in which the feed rate control mechanism shown in FIG. 6 is utilized will be described later.

Figure 7:
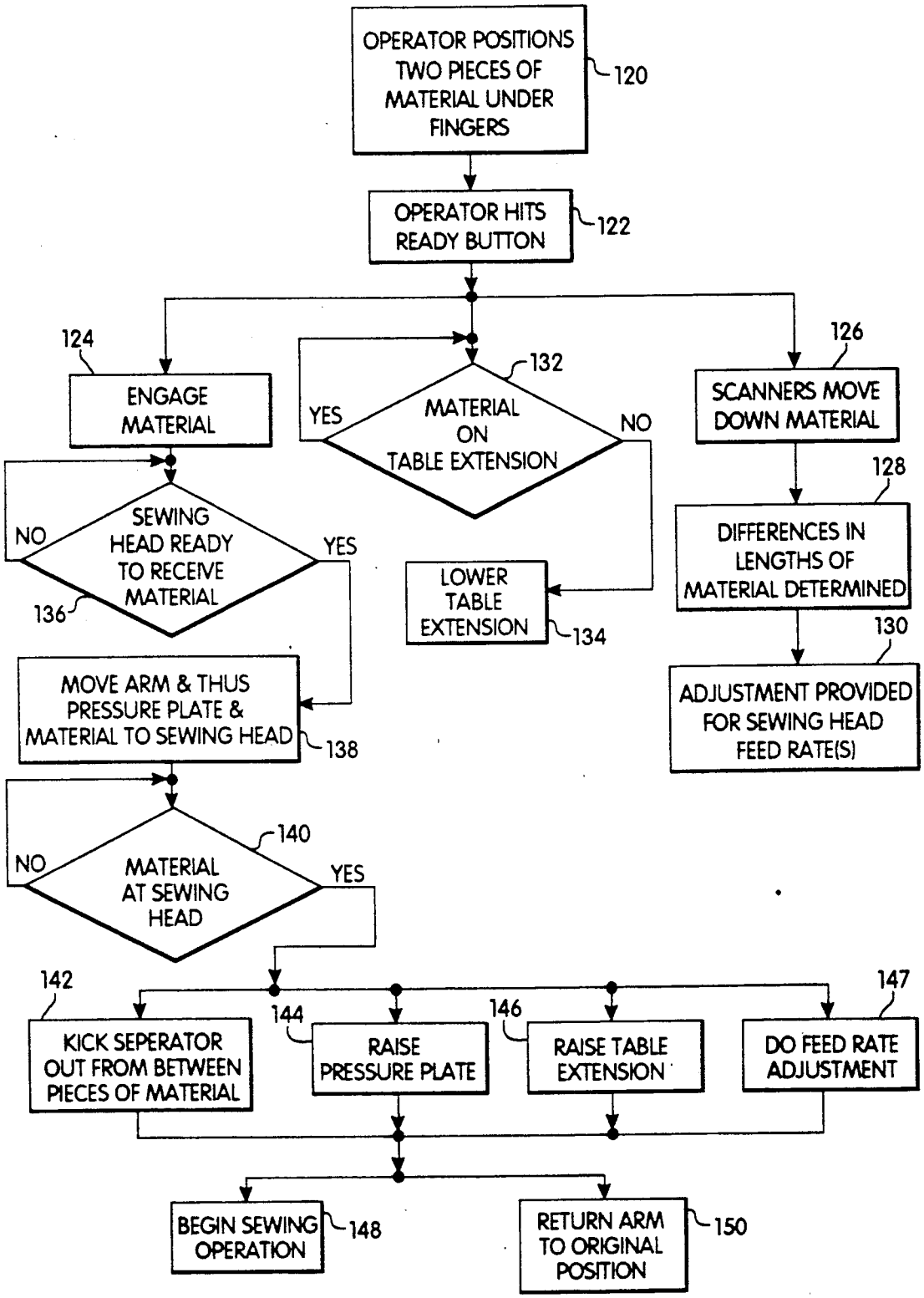
FIG. 7 is a flow diagram illustrating the operation of the apparatus shown in FIGS. 1—6.

FIG. 7 illustrates the operation of the system shown in FIGS. 1–5. Assume initially that two pieces of material which are in sewing head 14 are being sewn, that table extension 72 is in the raised position shown in FIG. 4, that arm 20 and the elements connected thereto are in the preload position shown in FIG. 1, that pressure plate assembly 42 is in the raised position shown in FIG. 2 and that the detector assembly 97 mounted to sleeve 100 is in the up position also shown in FIG. 2. At this time the operator positions two pieces of material which are to be sewn together in the apparatus by passing the two pieces of material under pressure plate 44 and under the fingers 38 until the leading edge of both pieces of material are aligned with the forward edge of fingers 38 and the left edge of the material is just to the left of the left edge of finger 38A. Fingers 38 thus serve as a guide for preloading the material. This is operation 120 shown in FIG. 7. The material 125 as preloaded is shown in phantom lines in FIGS. 1 and 2. From these figures, it is seen that only a small portion of the material is actually on table 12 at this time, with most of the material hanging over the right edge of the table. The operator adjusts the material hanging over the right edge so that one piece of material is on each side of separator plate 90. The operator also places separator finger 60 between the pieces or plies of material as shown in FIG. 2. When these operations are completed the operator is finished preloading the piece of material and indicates this by hitting ready button 110 (step 122).

Once ready button 110 has been pressed by the operator, the operation proceeds to steps 124 and 126 to perform two separate operations more or less simultaneously. During step 124, pneumatic pressure is applied through line 58 to pneumatic cylinder 52 to force piston 56 downward causing pressure plate 44 to press material 125 against the top of table 12.

During step 126, pressure is applied through line 104 to column 102 to drive collar 100 downward. This causes detector assembly 97 to move down along the pieces of material 125 hanging down on either side of separator plate 90. During this operation, piece of material 125B is between light source 95B and photodetector 96B, while piece of material 125A is between light source 95A and photodetector 96A. When each photodetector reaches the end of its respective piece of material, it generates an output to processor 114. Processor 114, during step 128, determines the difference in the time at which it receives the outputs from detectors 96A and 96B and utilizes this, during step 128, to determine from the known speed at which collar 100 is being driven, the difference in length between the two pieces of material 121A and 121B. Once the difference determination operation has been completed, pneumatic pressure is applied to line 106 to return collar 100 and the detector assembly 97 attached thereto to the position shown in FIG. 2.

From step 128, the operation proceeds to step 130 during which an adjustment is provided by processor and control 114 to sewing head 14 to control the rate at which either one or both of the pieces of material will be fed through the sewing head for at least a portion of the sewing operation. As indicated previously, assuming it is pants legs which are being sewn, it is desirable that the adjustments, which may be either adding fullness to the longer piece of material, stretching the shorter piece of material or both, is performed over the first third of the pants leg in the area above the knee. The adjustment which is determined to be required in order to correct for the length difference, which adjustment may for example be stored in a read only memory which is addressed by length differences, is preferably retained in processor 114 and applied to sewing head 14 when the now preloaded pieces of material 121 are loaded into the sewing head (see step 147).

Once the operations described above have been completed, nothing further happens until the material being sewn is no longer over photo detector 84. Thus, as illustrated by step 132, when material is no longer over detector 84, the operation proceeds to step 134 to either apply pneumatic pressure to pneumatic line 82 in a direction to cause table 72 to be lowered, or to merely remove pneumatic pressure from line 82, permitting table extension 72 to return to its lowered position shown in FIGS. 1 and 2 either by gravity or under the action of a spring or other suitable biasing means.

When the steps described above have been completed, the system, as illustrated by step 136, monitors to determine if material is still under detector 16. If material is still under detector 16, the sewing head is still sewing the loaded piece of material and is not ready to receive a new piece of material. When the piece of material being sewn is completed, an output is obtained from detector 16 which is applied to processor 114, indicating a "yes" output from step 136.

When this happens, material 125 may be loaded into the sewing head. This is accomplished during step 138 by applying pneumatic pressure to line 30 to drive collar 24 along rail 26 toward sewing head 14. This causes arm 20 and the various elements attached thereto to also move toward sewing head 14. In particular, since pressure plate 44 is bearing against material 125, it causes material 125 to be moved across the low friction top of table 12 toward the sewing head. Fingers 38 hold the leading edge of the material against the table. Since most of the material is hanging over the edge of table 20, such friction as there is on the material does not tend to skew the material, resulting in the alignment of the material being generally maintained.

Figure 5:
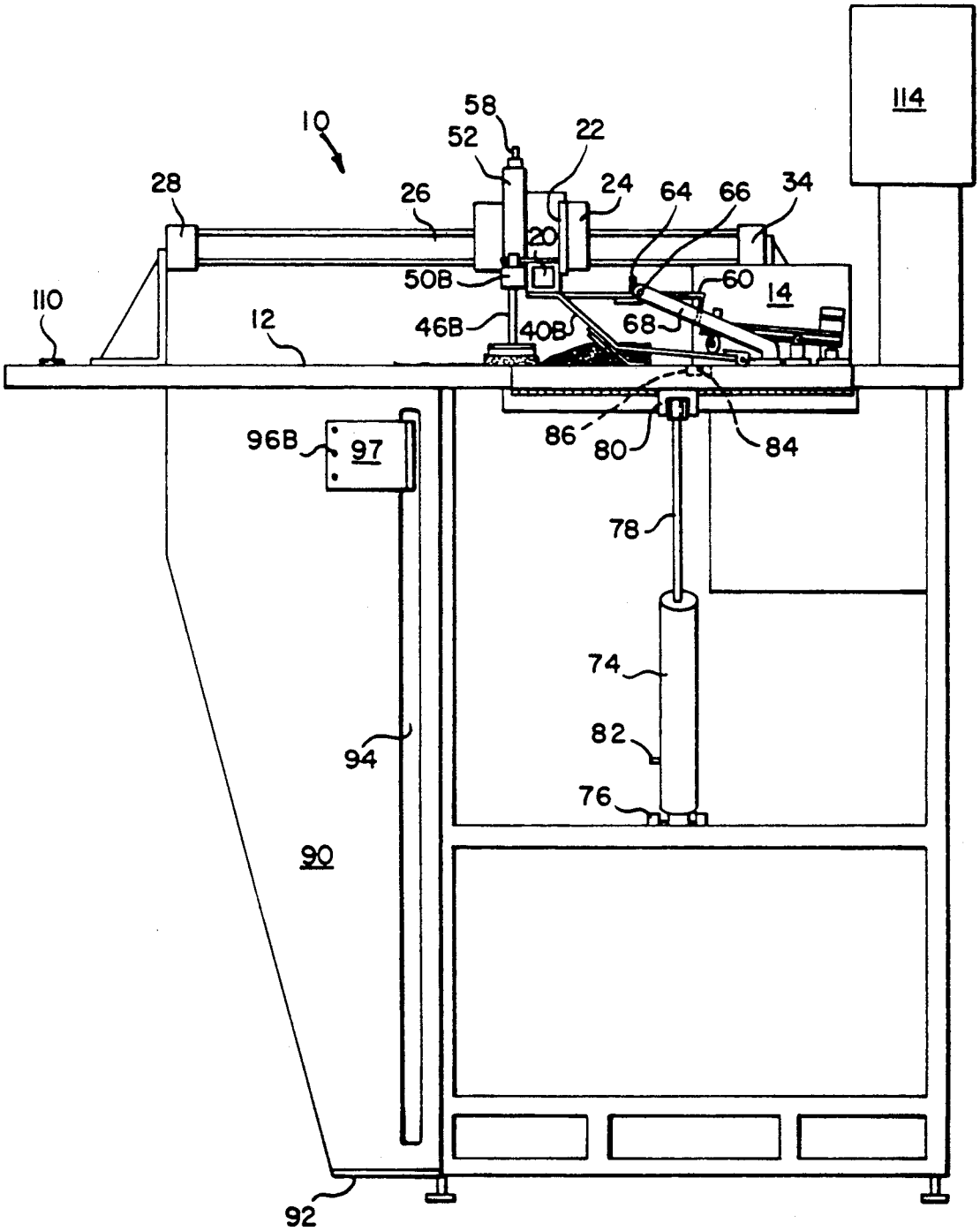
FIG. 5 is a partially broken side view taken generally along the line 5—5 in FIG. 4.

During step 140, a determination is made as to whether the material has reached the sewing head, with pneumatic pressure continuing to be applied through line 30 until this occurs When it is detected that the material is at the sewing head 14 by, for example, collar 24 reaching a predetermined point on rail 26, two operations occur. The first operation is a mechanical operation which does not depend on a detection of the material reaching the sewing head, and actually occurs slightly before the material reaches this point. As illustrated by step 142, when the material approaches sewing head 14, ar 66 contacts extension 64 on separator finger 60 kicking the separator finger 60 up and out from between pieces of material 125A and 125B. Because of the relative position of arm 66 and separator plate 70, separator 70 is between the two pieces of material when this occurs. The mechanics of this operation are best seen in FIG. 5.

The detection of the material reaching the sewing head causes a signal to be applied to control 114. In response, during step 144, control 114 either causes pneumatic pressure to be applied to cylinder 52 in a direction to raise piston 56, and thus to raise pressure plate 44, or merely removes pneumatic pressure from line 58, permitting piston 56 to be raised by a spring or other suitable biasing means. At the same time, pneumatic pressure is applied through line 82 to pneumatic cylinder 74, extending piston 78 to raise table extension 72 to the position shown in FIG. 4 with the plane of the extension being generally in the same plane as that of the table 12. This is illustrated by step 146.

Finally, at this time, the adjusted for difference in length between the two pieces of material, which was determined during step 130 and stored, is retrieved by processor 114 and is utilized to generate an appropriate signal or signals over line 116A and/or line 116B to the appropriate one or more of the servomotors 115. This results in a movement of the appropriate one or more of the shafts 117 which causes a corresponding movement of the appropriate arm or arms 119. This results in the appropriate one or more of the racks 123 being moved in an appropriate direction to adjust the feed rate of the upper piece of material 125A and/or lower piece of material 125B so as to compensate for the difference of length in the two pieces of material.

When the operations indicated above have been completed, the apparatus is ready to sew the two pieces of material 125A and 125B and control 114 causes the sewing operation to begin (step 148). At the same time, control 114 applies pneumatic pressure to line 32 to drive collar 24 and the arm 20 attached thereto back to the preload position shown in FIGS. 1 and 2. This is illustrated by step 150. When arm 20 is in its original position, a cycle of operation has been completed and the apparatus is ready for the operator to preload the next two pieces of material to be sewn. The operation this returns to step 120.

A method in apparatus is thus provided which permits material to be preloaded while a sewing operation is being performed and substantially reduces the period of time required to load a piece of material by eliminating the need for the operator to determine length differences between the two pieces of material being loaded and to make feed rate adjustments in the machine for such differences. The time required to complete a single sewing operation may thus be reduced by 50% or more resulting in substantially enhanced production from a single sewing machine.

While for the preferred embodiment, the various drives have been illustrated as being performed pneumatically, it is apparent that such operations could also be performed hydraulically or that suitable drive motors could be utilized for performing each of these operations. Further, while the material 125 has been illustrated as being engaged by having a pressure plate 44 press it against table 12, it is apparent that the material could be engaged in other ways. For example, vacuum could be applied to the lower surfaces of plate 44, fingers 38 or both in order to engage the material so that it may be moved from the preload to load position. Further, while photo detectors have been illustrated for performing the various detection operations, other types of detectors could also be utilized. Similar variations might also be made in the various other components of the system.

In addition, while for the preferred embodiment of the invention material 125 has been shown as hanging over the edge of table 12 during the length detection operation, and for various reasons indicated, this mode of operation is preferred, it is within the contemplation of the invention that the length difference detection operation could be performed with the material on the table 12 rather than hanging over the edge thereof. Similarly, while it is preferred that the length difference determination be fully automatic so that the operator need not become involved in this operation at all, it is also within the contemplation of the invention that this operation could be semi automatic. For this mode of operation, the operator would visually determine the difference in length between the two pieces of material, but rather than the operator having to manually enter an adjustment based on this difference determination, the operator would merely have to enter the estimated length difference into the processor 14 by suitable means. For example, assuming that, for a given operation, the difference in lengths would not exceed one inch, eight buttons could be provided, either on processor and control 114 or at another suitable location, with four of the buttons for the upper ply being longer in increments of one quarter inch and the other four buttons for the lower ply being longer in increments of one quarter inch. The operator would merely operate the appropriate button before hitting button 110, and processor 114 would automatically determine the appropriate adjustments in feed rate.

Thus, while the invention has been particularly shown and described with reference to a preferred embodiment, the foregoing and other changes of form and detail made therein by one skilled in the art without departing from the spirit and scope of the invention.

What is claimed is:

1. Apparatus for preloading two pieces of material which are to be sewn together in a sewing machine having a sewing head, material to be sewn being moved through the sewing head in a predetermined direction, the apparatus comprising:

a table, the sewing head being mounted near one end of the table;

an arm mounted above said table, the arm extending substantially fully across the table in a direction parallel to said predetermined direction and normally being positioned at a distance from the sewing head;

gripper means extending from said arm toward the table, at least a portion of the pieces of material being positioned under the arm between the gripper means and the table to preload the material;

means operative when the material is properly preloaded for lowering the gripper means to engage the material between the gripper means and the table;

means operative when the sewing head is ready to receive the material for moving the arm, and thus the preloaded material engaged by the gripper means, across the table toward the sewing head; and means operative when the material reached the sewing head for raising the gripper means to disengage the material, the means for moving the arm also being operative when the material is disengaged for returning the arm to its normal position.

2. Apparatus as claimed in claim 1 wherein said gripper means is a pressure plate which is lowered to press against the material, and is raised to disengage the material.

3. Apparatus as claimed in claim 1 including means positionable by the operator to separate the two pieces of material.

4. Apparatus as claimed in claim 3 including a separator plate at the sewing head, and means operative when the separator plate is between the two pieces of material for removing the means to separate from between the pieces of material.

5. Apparatus as claimed in claim 1 wherein only a portion of the two pieces of material are o the table when the material is preloaded, with most of the two pieces of material hanging down over an edge of the table which edge is substantially parallel to the direction of movement of said arm and on the side of the sewing head away from the direction of movement of the material therethrough.

6. Apparatus as claimed in claim 5 including a table extension from said edge at least in the sewing head area which extension is normally down with its plane at substantially a right angle to the table, and means for raising the table extension so that it is in substantially the same plane as the table when the material is at the sewing head.

7. Apparatus as claimed in claim 5 including means for detecting the relative lengths of the two pieces of material hanging down over the edge of the table.

8. Apparatus as claimed in claim 7 wherein said means for detecting includes a sensor for each piece of material, and means for moving the sensors down along the hanging portion of the pieces of material past the ends thereof.

9. Apparatus as claimed in claim 8 wherein said sensors are photosensors.

10. Apparatus as claimed in claim 1 including means for detecting the relative lengths of the two pieces of material; and means responsive to a detected difference in length between said two pieces of material for altering the feed rate for at least one of said pieces of material for at least a portion of the sewing operation.

11. Apparatus as claimed in claim 10 wherein said feed rate altering means include means forming part of said sewing machine for independently controlling the feed rate of each of said pieces of material a motor means for each of said feed rate controls, means for mechanically connecting each of said motor means to the corresponding feed rate control, and means responsive to said detected difference for selectively operating either one or both of said motor means.

12. A method for preloading two pieces of material which are to be sewn together by a sewing head of a sewing machine comprising the steps of:

mounting the material on a table under at least two gripper means, which gripper means are mounted above the table at a point spaced from the sewing head;

lowering the gripper means to apply pressure to the material and the table thereby engaging the material directly between the gripper means and the table;

moving the gripper means and the material engaged therewith toward the sewing head;

raising the gripper means to disengage the material when the material reaches the sewing head; and returning the gripper means to their initial position when the raising step is completed.

13. A method as claimed in claim 12 wherein said engaging step includes the step of lowering a pressure plate to press the gripper means against the material, and wherein said disengaging step includes the step of raising the pressure plate.

14. A method as claimed in claim 12 including placing a separator between the two pieces of material when they are mounted on said table.

15. A method as claimed in claim 14 wherein there is a separator plate at the sewing head, and including the step of removing the separator from between the pieces of material when the separator plate is therebetween.

16. A method as claimed in claim 12 wherein only a portion of the two pieces of material are on the table when the material is preloaded, with most of the two pieces of material hanging down over an edge of the table which edge is substantially parallel to the direction of movement of said gripper means and on the side of the sewing head away from the direction of movement of the material therethrough.

17. A method as claimed in claim 16 wherein there is a table extension from said edge at least in the sewing head area, which extension is normally down with its plane at substantially a right angle to the plane of the table, and including the step of raising the table extension so that it is substantially in the same plane as the table when the material is at the sewing head.

18. A method as claimed in claim 16 including the step of detecting the relative lengths of the two pieces of material hanging down over the edge of the table.

19. A method as claimed in claim 18 wherein there is a sensor for each piece of material; and including the step of moving the sensors down along the hanging portion of the pieces of material past the ends thereof.

20. A method as claimed in claim 12 including the steps of detecting the relative lengths of the two pieces of material; and altering the feed rate for at least one of the pieces of material for at least a portion of the sewing operation in response to the detected difference in length.

* * * * *